US005670932A

United States Patent [19]

Kizima

[11] Patent Number: 5,670,932

[45] Date of Patent: Sep. 23, 1997

[54] PIEZOELECTRIC SOUNDER

[75] Inventor: Kaoru Kizima, Akita-ken, Japan

[73] Assignee: TDK Corporation, Tokyo, Japan

[21] Appl. No.: 544,587

[22] Filed: Oct. 18, 1995

[30] Foreign Application Priority Data

Oct. 25, 1994 [JP] Japan ..... 6-260082

[51] Int. Cl.[6] ..... G08B 3/00

[52] U.S. Cl. ..... 340/384.6; 340/388.1; 381/190; 381/191; 310/322; 310/324

[58] Field of Search ..... 340/384.6, 388.1, 340/391.1, 387.1; 381/190, 191, 205, 174; 310/324, 322

[56] References Cited

U.S. PATENT DOCUMENTS

| | | | |
|---|---|---|---|
| 4,023,162 | 5/1977 | Murakami | 340/384.6 |
| 4,325,060 | 4/1982 | Purtell et al. | 340/384.6 |
| 4,374,377 | 2/1983 | Saito et al. | 340/384.6 |
| 4,429,247 | 1/1984 | Feldman | 340/384.6 |
| 4,486,742 | 12/1984 | Kudo et al. | 340/384.6 |
| 4,604,606 | 8/1986 | Sweany | 340/384.6 |
| 4,641,054 | 2/1987 | Takahata et al. | 340/384.6 |

FOREIGN PATENT DOCUMENTS

| | | |
|---|---|---|
| 63-44599 | 3/1988 | Japan . |
| 3-143200 | 6/1991 | Japan . |
| 3-80495 | 8/1991 | Japan . |

*Primary Examiner*—Jeffery Hofsass
*Assistant Examiner*—Davetta C. Woods
*Attorney, Agent, or Firm*—Browdy and Neimark

[57] ABSTRACT

A piezoelectric sounder quickly discharges water when such water enters and eliminates the influence of water or moisture thus intruded. A cylindrical case with a closed bottom is made of glass-fiber reinforced polyester resin, a metal vibrating plate with a piezoelectric ceramic disk mounted on it is fixed on a graded step formed inside the cylindrical case with a closed bottom using a silicon type adhesive, and a conductive layer and the disk-like metal vibrating plate are contacted with two connection terminals. On a circumference side of the case, at least one opening serves as a sound releasing hole and a water drain hole and silicon varnish is coated on at least the surface where the piezoelectric vibrator contacts the two terminals. This sounder has no sound hole at the bottom and even when water drops enter, water is discharged through the opening extended to the bottom of the case. Silicon varnish is coated on at least the surface of the piezoelectric vibrator with which the two connection terminals are in contact so water has no effect. The side of the metal vibrating plate where silicon varnish is coated may be water-tightly fixed on the graded step formed inside the cylindrical resin case using a silicon type adhesive, and the sound and water releasing hole opening on the circumference side of the case may extend from the graded step in the cylindrical resin case toward the bottom thereof.

3 Claims, 4 Drawing Sheets

FIG. 4a
(PRIOR ART)
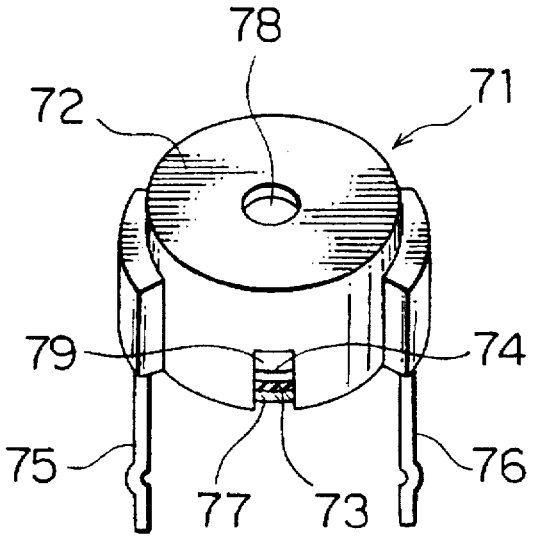
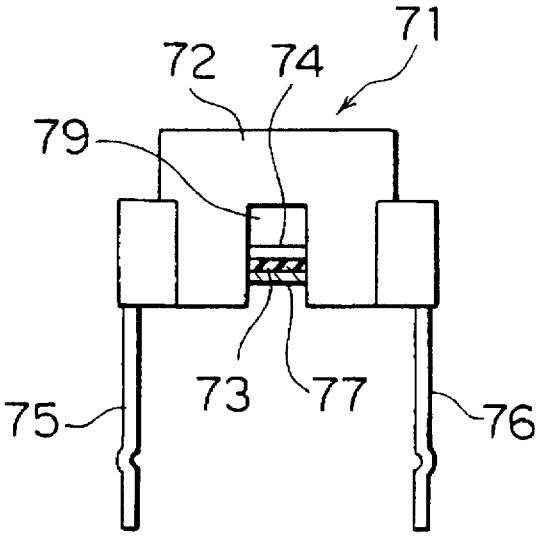
FIG. 4b
(PRIOR ART)

PIEZOELECTRIC SOUNDER

BACKGROUND OF THE INVENTION

1. Field of the Invention

The present invention relates to a piezoelectric sounder, which is used as a source of alarm sound in electric appliances such as washing machines, laundry dryers, dish dryers, etc. used under the conditions where water or moisture is present.

2. Description of the Prior Art

The electric appliances such as washing machines, laundry dryers, dish dryers, etc. are equipped with alarms to announce the completion of the working process, and a piezoelectric sounder using a piezoelectric element is used in many cases as a source of such alarm sound.

FIGS. 4*a* and 4*b* represent an external view of a conventional type piezoelectric sounder described in Japanese Utility Model Publication Laid-Open 3-80495, and FIG. 4*a* represents a perspective view, and 4*b* is a side view of the sounder.

In a piezoelectric sounder 71, a metal vibrating plate 74 is mounted in electrical and mechanical connection on one side of a piezoelectric disk 73, and a conductive layer 77 is mechanically and electrically connected with the other side, and all these components are accommodated in a cylindrical case 72 with a closed bottom. Lead wires 75 and 76 are connected to the metal vibrating plate 74 and the conductive layer 77 respectively. While AC signal is applied to the metal vibrating plate 74 and the conductive layer 77 via these lead wires, the piezoelectric disk 73 is vibrated. Then, the metal vibrating plate 74 is vibrated and sound is issued. To reverberate this sound to outside, a sound releasing hole 78 is provided at the bottom of the cylindrical case 72.

Under the conditions where these appliances such as washing machines, laundry dryers, dish dryers, etc. equipped with piezoelectric sounders are used, the presence of water or moisture is unavoidable. For this reason, in the piezoelectric sounder 71 used in these appliances, waterdrops enter through the sound releasing hole 78 or water vapor thus entered is condensed. As a result, waterdrops are attached on the side to which the metal vibrating plate 74 or the conductive layer 77 are connected with lead wires 75, 76, and the portion where the lead wires 75, 76 are connected to the metal vibrating plate 74 or the conductive layer 77 may be corroded due to the attached waterdrops. Consequently, mechanical and electrical connection between the piezoelectric disk 73 and the metal vibrating plate 74, between the piezoelectric disk 73 and the conductive layer 77, or between the metal vibrating plate 74 or the conductive layer 77 and lead wires 75, 76 may become incomplete, and this often leads to malfunction of the piezoelectric sounder 71 or deterioration on the properties of these components.

To block the intrusion of water or moisture, the entire case may be tightly closed, while the sound releasing hole 78 is needed to efficiently reverberate the alarm sound.

To discharge the invading waterdrops, a plurality of water drain holes 79 are formed on the circumference side of the cylindrical case 72 of the piezoelectric sounder 71.

However, it is often difficult to drain the invaded water or moisture due to the mounting position of the piezoelectric sounder 71. In such case, malfunction or deterioration of the properties occurs in the piezoelectric sounder 71.

SUMMARY OF THE INVENTION

To overcome the above problems, it is an object of the present invention to provide a piezoelectric sounder, by which it is possible to eliminate the sound releasing hole at the bottom of the sounder, through which waterdrops enter, and to discharge water or moisture quickly and to dismiss the influence of the invading water and moisture.

To attain the above object, the piezoelectric sounder according to the present invention comprises a case having approximately cylindrical shape with a closed bottom and a graded step inside and being made of glass-fiber reinforced polyester resin, a piezoelectric vibrating plate with a metal vibrating plate mounted on a conductive layer on one side of a disk-like piezoelectric vibrator having conductive layers on both sides and being fixed over the entire periphery of the graded step disposed inside the cylindrical resin case with a closed bottom using silicon type adhesive, the metal vibrating plate and the conductive layer being connected a lead wire respectively, and the piezoelectric vibrating plate being coated silicon varnish on at least a surface thereof to which the lead wires are connected, whereby at least one opening is formed on a side of the case from an open end to the bottom, and said opening serving as a sound releasing hole and a water drain hole.

In the piezoelectric sounder of the present invention with the above arrangement, waterdrops are most unlikely to enter because no sound releasing hole is formed on the bottom tending to be as waterdrops intruding. Even when waterdrops or water vapor enter through the opening, which simultaneously serves as a sound releasing hole and a water drain hole, waterdrops or vapor are discharged through the opening, which extends up to the case bottom. Further, the influence of water is eliminated because of silicon varnish coated on the piezoelectric vibrator.

BRIEF DESCRIPTION OF THE DRAWINGS

FIGS. 4*a*–4*b* represent a perspective view and a side view of a conventional type piezoelectric sounder.

DESCRIPTION OF THE PREFERRED EMBODIMENTS

In the following, description will be given on the construction of an embodiment of a piezoelectric sounder of the present invention.

Figure 1A:
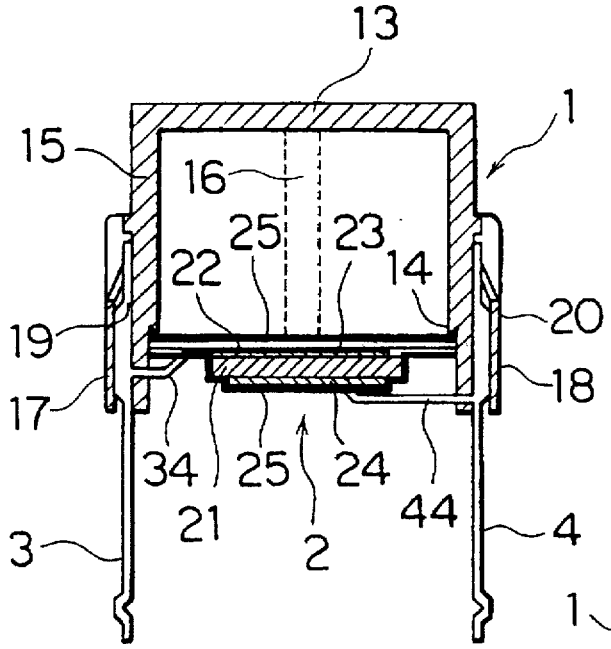
FIGS. 1*a*–1*c* represent an overall cross-sectional view, an exploded perspective view, and a partially enlarged view of a piezoelectric sounder of an embodiment of the present invention.
Figure 1B:
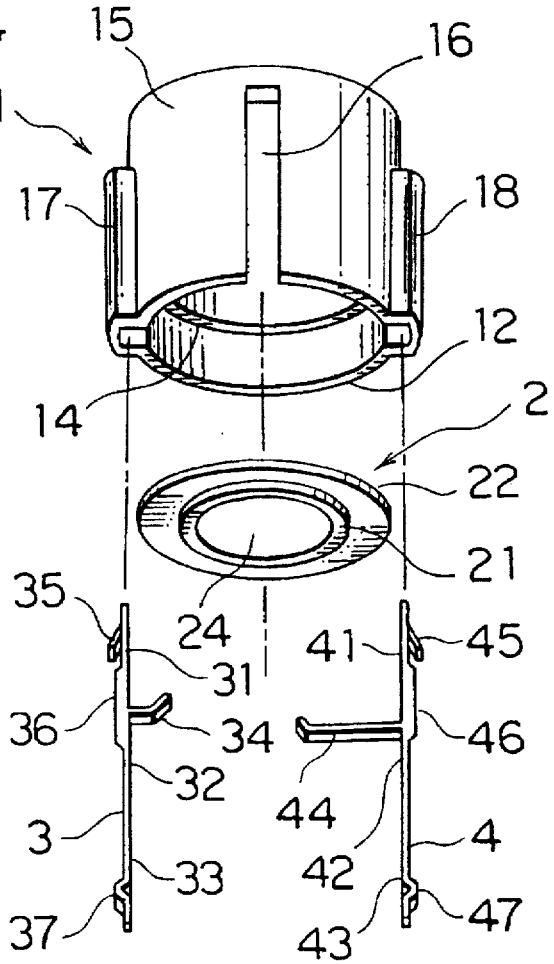
Figure 1C:
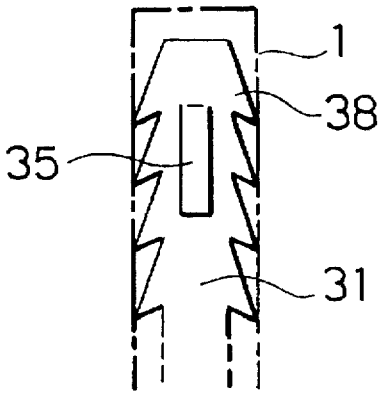

FIGS. 1*a*, 1*b* and 1*c* represent drawings for explaining internal arrangement of the piezoelectric sounder of the present invention, where 1*a* represents a cross-sectional view, 1*b* represents an exploded perspective view, and 1*c* represents a partially enlarged view of a connection terminal.

This piezoelectric sounder comprises a case 1, a piezoelectric vibrator 2 and connection terminals 3 and 4.

The case 1 comprises glass-fiber reinforced polyester resin and is designed in cylindrical shape as a whole. One end of the cylinder is an open end 12, while a bottom 13 is provided at the other end. Inside the cylinder near the open end 12, a graded step 14 is formed.

On a side 15 of the cylindrical case 1, at least one rectangular opening 16 is formed, extending from the open end 12 to the bottom 13. This opening 16 serves simultaneously as a sound releasing hole 78 and a water drain hole 79 in the conventional type sounder shown in FIGS. 4*a* and 4*b*. Therefore, no sound releasing hole is formed on the bottom 13 of the case 1.

The piezoelectric vibrator 2 comprises a piezoelectric ceramic disk 21 made of piezoelectric ceramics such as PZT and a metal vibrating plate 22 made of nickel alloy and having a diameter larger than that of the piezoelectric ceramic disk 21 and suitable for being engaged with the graded step 14 inside the cylinder. Conductive layers 23 and 24 are formed on two sides of the piezoelectric ceramic disk 21 respectively. With the conductive layer 23 electrically connected with the metal vibrating plate 22, the piezoelectric ceramic disk 21 is integrally connected with the metal vibrating plate 22, thus constituting the piezoelectric vibrator 2.

In the piezoelectric vibrator 2, the metal vibrating plate 22 is fixed on the graded step 14 of the case using a water-repellent and water-resistant silicon type adhesive in such manner that the piezoelectric ceramic disk 21 is positioned closer to the open end of the cylindrical case.

The connection terminals 3 and 4 are made of phosphor bronze and each comprises a head 31 or 41, a body 32 or 42, a leg 33 or 43, and a contact 34 or 44. On the head 31 or 41, an engaging tongue 35 or 45 is formed. A projection 36 or 46 is formed on the body 32 or 42, and the leg 33 or 43 is provided on an elastic sector 37 or 47.

On the other hand, connection terminal inserts 17 and 18 are provided on the sides of the case 1 respectively, and the heads 31 or 41 and the projections 36 or 46 of the connection terminals 3 or 4 are inserted into the connection terminal inserts 17 and 18 respectively. The engaging tongues 35 or 45 of the connection terminal 3 or 4 are respectively engaged with engaging portions 19 or 20 formed in the connection terminal inserts 17 or 18. When the projections 36 and 46 are forcibly inserted into the connection terminal inserts 17 and 18 respectively, the connection terminals 3 and 4 are mounted on the case 1.

FIG. 1*c* is an enlarged view of the head 31 seen from lateral side for explaining how the connection terminal 3 is inserted into the connection terminal insert 17. As shown in this figure, a serrated portion 38 is formed on the head 31, and this serrated portion 38 ensures reliable mounting of the connection terminal 3 to the case 1.

The connection terminals 3 and 4 are approximately identical with each other in configuration, while they are different from each other in that the configuration of the contact 44 in contact with a conductive layer 24 is different from that of the contact 34, which is in contact with the metal vibrating plate 22. As it is evident from FIG. 1*a*, the contact 34 of the connection terminal 3 is in contact with the metal vibrating plate 22 having larger diameter and positioned above, while the contact 44 of the connection terminal 4 is in contact with the conductive layer 24 having smaller diameter and positioned below.

In this respect, the contact 34 of the connection terminal 3 is formed at a position closer to the head 31 and is designed shorter than the contact 44 of the connection terminal 4. In other words, the contact 44 of the connection terminal 4 is arranged at a position more distant from the head 41 and is longer than the contact 34 of the connection terminal 3.

While in the piezoelectric vibrator 2 of this embodiment, the piezoelectric ceramic disk 21 is fixed so as to be positioned at the side facing the open end of the cylindrical case, the piezoelectric ceramic disk 21 in the piezoelectric vibrator 21 may be fixed so as to be positioned at opposite side of the open end of the cylindrical case. In this case, the contact 34 of the connection terminal 3 or the contact 44 of the connection terminal 4 is in contact with the the metal vibrating disk 22 or the conductive layer 23 respectively at the side thereof opposite to facing the open end of the cylindrical case.

Further, silicon varnish 25 is coated on at least a surface of piezoelectric vibrator 2 where connection terminals are contacted with for waterproof purpose after assembling, and it is spontaneously cured or cured by heating up to the temperature within the heat-resistant range of the case 1.

In the piezoelectric sounder of the embodiment of the present invention with the above arrangement, the sound generated by the piezoelectric vibrator 2 is reverberated from the opening 16, which is formed on the circumference side of the cylindrical case with a closed bottom, extending from the open end 12 to the bottom 13 and serves as a sound releasing hole and a water drain hole, and water intruded into the case 1 can be easily drained.

Figure 2:
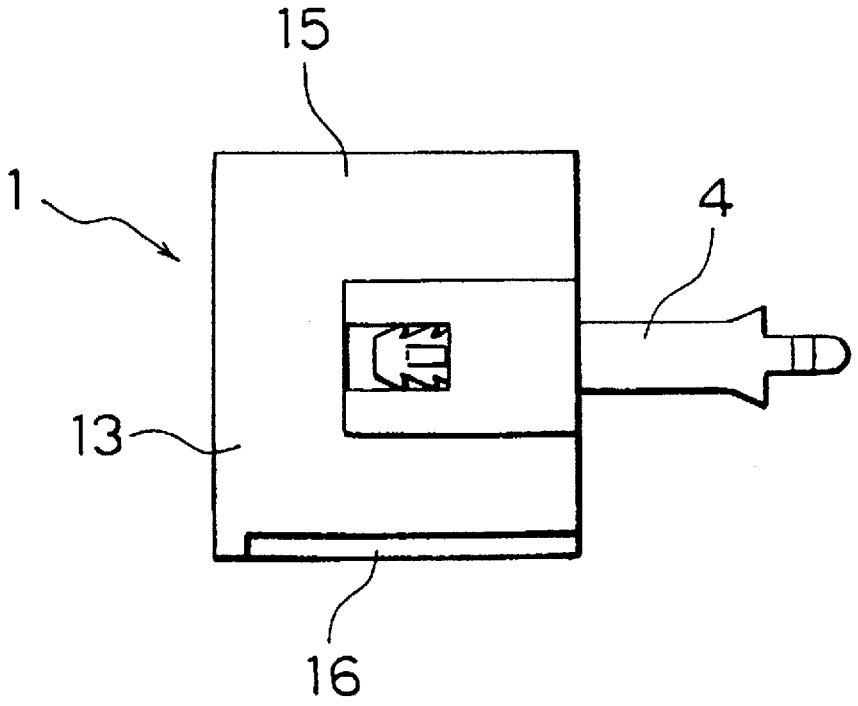
FIG. 2 is a drawing for explaining an arrangement of the piezoelectric sounder of an embodiment of the present invention.

In the basic mounting position, the metal vibrating plate is positioned horizontally as shown in FIGS. 1*a*–1*c*, while the metal vibrating plate may be positioned vertically as shown in FIG. 2 depending upon the structure of the appliance, on which the sounder is to be mounted.

In this case, it may be designed in such manner that the opening 16 faces downward as shown in FIG. 2, so that the water intruded into the case 1 is easily drained through the opening 16.

To form the opening 16, optimal position should be selected by taking the mounting position into account. In case two or more mounting positions are anticipated, the opening 16 should be designed at a position, which is most suitable for the mounting position of the sounder.

As described above, the opening formed on the side of the case of the piezoelectric sounder serves simultaneously as a sound releasing hole and a water drain hole. As a result, waterdrops do not enter inside through the sound releasing hole as in the conventional type piezoelectric sounder where the sound releasing hole is arranged at the bottom. Thus, the water entering through the opening on the side of the case can be easily discharged through the opening.

Because water repellent and water-resistant silicon varnish is coated on the piezoelectric vibrator on at least the side thereof where connection terminals 3 and 4 are in contact with, it is possible to eliminate the problems in the conventional type piezoelectric sounder, in which mechanical and electrical connections between the piezoelectric disk and the metal vibrating plate, between the piezoelectric disk and the conductive layer, or between the metal vibrating plate or the conductive layer and the lead wires becomes incomplete or malfunction or deterioration of properties of the piezoelectric sounder often occur.

Because the opening can be designed at an adequate position on the side of the cylindrical resin case with a closed bottom, it is possible to obtain a piezoelectric sounder, which can be mounted at any position on any type of appliances.

Figure 3A:
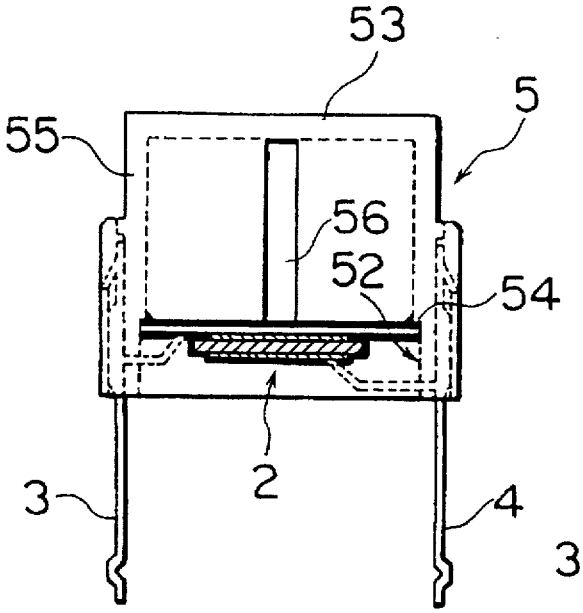
FIGS. 3*a*–3*c* represent an overall cross-sectional view, an internal cross-sectional view and an enlarged internal cross-sectional view of a piezoelectric sounder of another embodiment of the present invention.
Figure 3B:
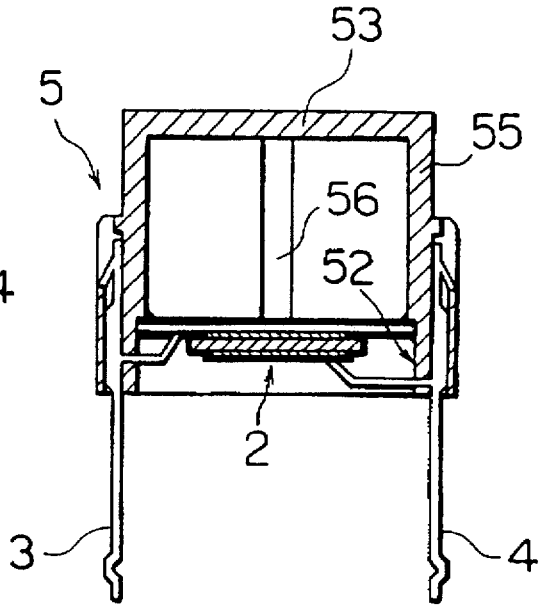
Figure 3C:
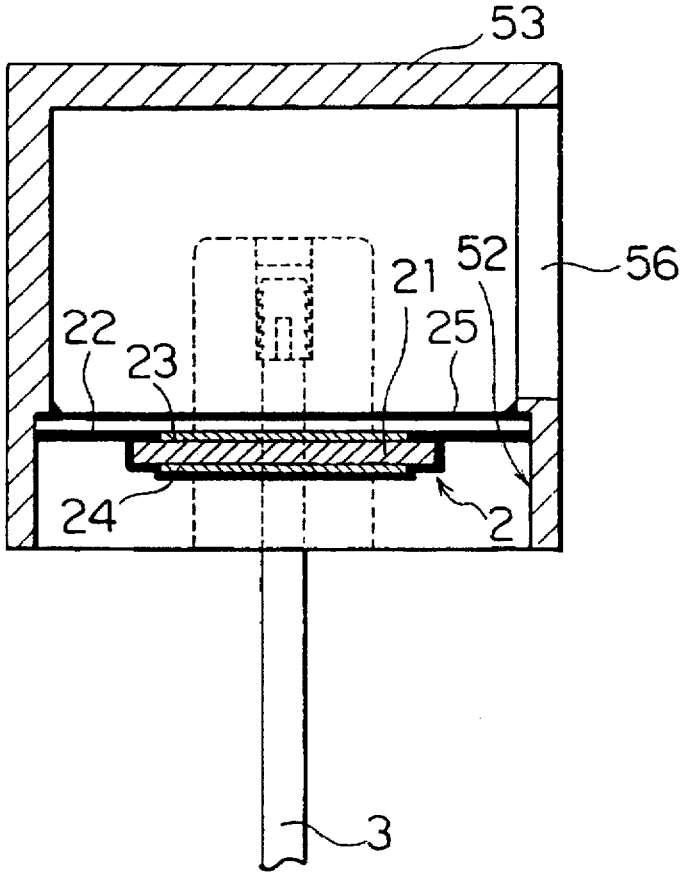

FIGS. 3*a*–3*c* are drawings for explaining internal arrangement of the piezoelectric sounder of another embodiment of the invention. FIG. 3*a* represents a front view of a piezoelectric sounder illustrated a piezoelectric vibrator, FIG. 3*b* is a cross-sectional view seen from the front, and FIG. 3*c* is an enlarged cross-sectional view seen from lateral side.

As in the piezoelectric sounder of the first embodiment of the invention shown in FIGS. 1*a*–1*c*, this piezoelectric sounder comprises a case 5, a piezoelectric vibrator 2 and connection terminals 3 and 4, while the configuration of an opening 56 formed on the case 5 is different from that of the opening 16 of the piezoelectric sounder in the embodiment shown in FIGS. 1*a*–1*c*.

The case 5 is made of glass-fiber reinforced polyester resin and is designed in cylindrical shape as a whole. One end of the cylinder is designed as an open end 52, and a closed bottom 53 is arranged on the other end. A graded step 54 is formed inside the cylinder near the open end 52.

On circumference side 55 of the cylindrical case 5, at least one rectangular opening 56 is formed, extending from the graded step inside the cylinder of the case 5 to a position closer to the closed bottom 53. This opening 56 serves simultaneously as a sound releasing hole 78 and a water drain hole 79 as shown in FIG. 4. Therefore, no sound releasing hole is formed on the bottom 53 of the case 5.

The piezoelectric vibrator 2 comprises a piezoelectric ceramic disk 21 made of piezoelectric ceramics such as PZT and a metal vibrating plate 22 made of nickel alloy and having a diameter larger than that of the piezoelectric ceramic disk 21 and suitable for being engaged on the graded step 54 formed inside the cylinder. On both sides of the piezoelectric ceramic disk 21, conductive layers 23 and 24 are formed. Because the conductive layer 23 is connected to the metal vibrating plate 22, the piezoelectric ceramic disk 21 is integrated with the metal vibrating plate 22, thus constituting the piezoelectric vibrator 2.

On the side of the metal vibrating plate 22 opposite to the piezoelectric ceramic disk 21, water-repellent and water-resistant silicon varnish 25 is coated. The metal vibrating plate 22 is mounted on the graded step 54 with the piezoelectric ceramic disk 21 on the side opposite to the graded step 54 and it is water-tightly fixed using a water-resistant silicon type adhesive.

The arrangement of the connection terminals 3 and 4 and the inserting condition of the connection terminals 3 and 4 in the connection terminal insert are the same as the piezoelectric sounder shown in FIGS. 1*a*–1*c*, and detailed description is not given here.

In the piezoelectric sounder of the present embodiment with the above arrangement, the rectangular opening 56 formed on the circumference side 55 of the cylindrical case 5 is extending from the graded step 54 arranged inside the cylinder of the case 5 to a position closer to the bottom 53.

On the side of the metal vibrating plate 22 facing to the opening 56, water-resistant silicon varnish 25 is coated, and this side is mounted on the graded step 54 and is water-tightly fixed using a water-resistant silicon adhesive.

As a result, the water entering the case 5 through the opening 56, which also serves as a sound releasing hole, does not intrude into the portion where the piezoelectric ceramic disk and other components are accommodated. This eliminates the problems of the conventional type piezoelectric sounder, such as incomplete mechanical and electrical connection between the piezoelectric disk 21 and the metal vibrating plate 22 or between the piezoelectric disk 21 and the conductive layers 23, 24 or malfunction or deterioration of properties of the piezoelectric sounder.

The cylindrical case is not always necessary to form an exact cylindrical shape, and may be forming a appropriate shape such as an elliptical cylinder-shape.

What is claimed is:

1. A piezoelectric sounder, comprising:

a case made of resin and having approximately cylindrical shape with a closed bottom and a graded step inside;

a piezoelectric vibrator having conductive layers on both sides of a piezoelectric ceramic substrate having a general disk-shape and a generally disk-shaped metal vibrating plate mounted on one of said conductive layers; and two connection terminals in contact with said conductive layers and said metal vibrating plate, wherein:

a peripheral edge portion of said metal vibrating plate is bonded to said graded step formed inside said resin case using a silicon-containing adhesive;

silicon-containing varnish is coated on a surface of said metal vibrating plate and conductive layers in said piezoelectric vibrator where said two connection terminals are in contact with said conductive layers; and an opening is formed only on a circumference side of said resin case.

2. The piezoelectric sounder according to claim 1, wherein said case includes an open end opposite said closed bottom, and wherein said opening extends from the open end of said resin case toward the closed bottom thereof.

3. The piezoelectric sounder according to claim 1, wherein the silicon-containing varnish is coated further on another surface of said metal vibrating plate; and wherein said opening extends from the graded step of said resin case toward the closed bottom thereof.

* * * * *